United States Patent [19]

Mander et al.

[11] 4,156,509

[45] May 29, 1979

[54] WIRE SPOOLER

[75] Inventors: Keith A. Mander, Romiley; Keith J. Mitchell, Higham; Barry A. Kempster, Bexley; David Rodger, Cliffe, all of England

[73] Assignee: Babcock Wire Equipment Limited, Kent, England

[21] Appl. No.: 827,690

[22] Filed: Aug. 25, 1977

Related U.S. Application Data

[62] Division of Ser. No. 669,822, Mar. 24, 1976, Pat. No. 4,083,506.

[30] Foreign Application Priority Data

Nov. 20, 1975 [GB] United Kingdom ..... 36779/75
Nov. 20, 1975 [GB] United Kingdom ..... 36780/75

[51] Int. Cl.[2] ..... B65H 54/28

[52] U.S. Cl. ..... 242/25 R; 242/158.2; 242/158.4 R

[58] Field of Search ..... 242/25 R, 45, 75, 75.43, 242/75.44, 75.5, 75.51, 147 R, 149, 150 R, 155 R, 156.2, 156, 158 R, 158 B, 158.2, 158.4 R, 158.4 A

[56] References Cited

U.S. PATENT DOCUMENTS

| | | | |
|---|---|---|---|
| 3,038,674 | 6/1962 | Wahl | 242/25 R |
| 3,231,216 | 1/1966 | Lemarchand | 242/150 R |
| 3,413,834 | 12/1968 | Kovaleski | 242/25 R X |
| 3,677,483 | 7/1972 | Henrich | 242/25 R |
| 3,876,167 | 4/1975 | Nittschalk et al. | 242/25 R X |
| 3,967,787 | 7/1976 | Mulleman | 242/25 R |
| 4,004,744 | 1/1977 | Hoorelbeke | 242/25 R |

FOREIGN PATENT DOCUMENTS

| | | | |
|---|---|---|---|
| 938015 | 9/1963 | United Kingdom | 242/45 |

*Primary Examiner*—Stanley N. Gilreath
*Attorney, Agent, or Firm*—Kemon & Estabrook

[57] ABSTRACT

A spooler arranged for leading wire to a rotating spool through a wire tension controller and winding it onto the spool while distributing it in alternating directions along the spool between flanges thereof has means for varying the length of the distribution in either direction, arranged to be so controlled by means responsive to changes in the length of the wire in the wire tension controller in a period adjacent the moment of change to the other distribution direction as at least to reduce wound wire profile deficits or excesses adjacent the spool flanges.

9 Claims, 6 Drawing Figures

WIRE SPOOLER

This is a division of application Ser. No. 669,822, filed Mar. 24, 1976, now U.S. Pat. No. 4,083,506.

BACKGROUND OF THE INVENTION

This invention relates to spoolers arranged for leading wire to a rotating spool through a wire tension controller and winding it onto the spool while distributing it in alternating directions along the spool between flanges thereof.

The wire tension controller has the function of absorbing disturbances in the continuous wire movement to the spool from the previous apparatus, such as the wire drawing machine manufacturing the wire or an annealer through which the wire passes from the wire drawing machine, while being intended to maintain on the one hand tension in the wire being wound on the spool and on the other hand tension in the wire leaving the previous apparatus.

If the wire is wound on the spool under tension with a correct length of distribution in either direction between the spool flanges the wire should be steadily unreelable from the spool by the user without transient wire looseness or snatches. However, if the flanges of re-used spools have become distorted or if wear in re-used spools gives locational inaccuracy on the spooler arbor or pintles or if the spools are cheaply made for disposal and have variable dimensions, correctness of the wire distribution cannot be ensured by a single presetting of the wire distribution mechanism. If the wire distribution is incorrect, however, wound wire profile deficits or excesses will occur adjacent the spool flanges and these, which in bad cases may even be associated with the overlapping of later coils by earlier ones, may frequently be unfavourable to a steady unreeling.

SUMMARY OF THE INVENTION

According to the invention, a spooler arranged for leading wire to a rotating spool through a wire tension controller and winding it onto the spool while distributing it in alternating directions along the spool between flanges thereof has means for varying the length of the distribution in either direction, arranged to be so controlled by means responsive to changes in the length of the wire in the wire tension controller in a period adjacent the moment of change to the other distribution direction as at least to reduce wound wire profile deficits or excesses adjacent the spool flanges.

Preferably means are arranged to maintain constant the relation between wire speed and spool speed during each of the said periods. If the speed of the wire approaching the spooler is constant it clearly suffices for the purposes to maintain the spool speed constant during each of said periods.

Preferably also, the means for varying the length of the distribution in either direction are arranged to be effective only while distribution in the other direction is taking place.

The invention applies whether the wire distribution is effected by reciprocating the spool or by reciprocating a carriage, carrying a wire distributor pulley. It also applies whatever the kind of wire tension controller, however, our experiments and designs have been in connection with wire tension controllers of the dancing arm kind, in which changes in wire length in the wire tension controller may be measured by changes in dancing arm angular position.

When the wire tension controller is of a kind with a dancing arm and the distribution of the wire along the spool between the spool flanges is effected by means of a distributor pulley on a reciprocating carriage, means responsive to changes in the angular position of the dancing arm may be used to adjust the reversal points of the reciprocating carriage.

BRIEF DESCRIPTION OF THE DRAWINGS

The invention will now be described by way of example with reference to the accompanying drawings, in which.

DETAILED DESCRIPTION OF THE INVENTION

Figure 1:
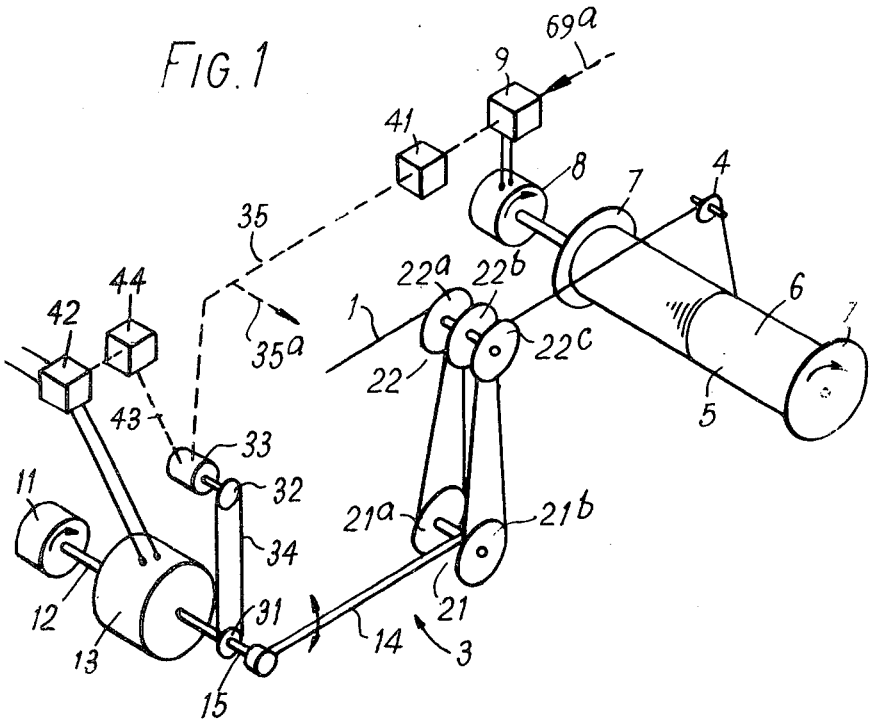
FIG. 1 shows schematically the mechanical parts and some of the control means of a wire spooler with a dancing arm tension controller.

With reference to FIGS. 1 to 4 of the drawings, a wire spooler for wire 1 from a wire drawing machine (not shown) includes a wire tension controller 3 through which the wire passes before it runs over a lead-in distributor pulley 4 onto the spool 5 on which the wire is to be collected. The spool 5 provides a cylindrical wire-receiving surface 6 bounded by end flanges 7. For rotating the spool we prefer to use an electric motor driving through a hydraulic pump and motor pair, of which a control lever on the hydraulic pump provides means for adjusting the spool speed. The item 8 in FIG. 1 represents such motive means and the item 9 the spool speed adjusting means therefor. The axis of the lead-in distributor pulley 4 is parallel to the spool axis and it is mounted for free rotation in a carriage 10 (FIG. 3) arranged to be reciprocated along a path parallel to the spool axis so that the lead-in distributor pulley 4 may effect a boustrophedon lay of the wire on the spool surface 6. Since the lead-in pulley 4 is moved to effect the wire distribution along the spool between the flanges, it will be referred to as the distributor pulley.

The wire tension controller 3 comprises a high speed electric motor 11 arranged for driving the input shaft 12 of a variable torque drive coupling 13 as sold by Smiths Industries Limited and identified as Type SFU 500, a lightweight arm 14 mounted by one end on the output shaft 15 of the coupling 13 and extending laterally from the output shaft 15, a pulley block 21 mounted at the other end of the arm comprising a pair of lightweight pulleys 21*a* and 21*b* mounted so as to be freely rotatable and to have a common axis of rotation parallel to the coupling axis, and a fixed pulley block 22 comprising three lightweight pulleys *22a, 22b* and *22c* mounted so as to be freely rotatable and to have a common axis of rotation also parallel to the coupling axis. The wire 1 links the pulley block 21 to the pulley block 22 by engaging successively the pulleys *22a, 21a, 22b, 21b* and *22c,* whence it runs to the distributor pulley 4. The direction of rotation of the motor 11 is such as to apply, when the coupling 13 is energized, a torque to the arm 14 tending to increase the distance of the pulley block 21 from the pulley block 22.

The coupling 13 is designed primarily for power transmission between its input and output shafts either by a positive drive or by a drive with a controlled amount of slip but we use it in the tension controller 3 in a comparatively unusual mode not to transmit rotary power but to generate a torque on the output shaft which is prevented from rotation. Reference may be made to e.g. British Pat. No. 938,015 for a description of principles of operation of the coupling, but for the sake of convenience it is here explained with reference to FIG. 2 that the coupling includes a stationary annular magnetic armature 23 enclosing an annular exciting coil 24 and formed with an annular air gap 25 at its inner face, an outer rotary annular armature 26 arranged for rotation within the stationary armature and an inner rotary annular armature 27 which is arranged for rotation within the rotary annular armature 26 and which closes a path for magnetic flux generated in the stationary armature 23 by the coil 24. Closure of the magnetic flux path in the outer rotary armature 26 rather than in the inner rotary armature 27 is inhibited by an annular groove 28 formed in the outer rotary armature 26 and registering with the air gap 25 in the stationary armature 23. The input shaft 12 is attached to one of the two rotary armatures 26 and 27, as shown it is arranged for drive of the outer rotary armature 26, and the output shaft 15 is attached to the other of the two rotary armatures. With the aid of an annular labyrinth sealing device 29 a chamber 30 is formed within which the inner rotary armature 27 rotates and which contains ferromagnetic powder, not shown, which is effected by the magnetic flux in the annular gap between the inner and the outer rotary armatures and when one of the rotary armatures is rotated transmits to the other rotary armature a torque which is greater the greater the excitation by the coil 24 and which remains substantially constant during all phases of any transient movements that may be executed by the arm 14.

We find the use of the powder coupling in non-rotary output mode to provide the dancing arm torque advantageous and that it may well favour high speed operation without wire breaks.

A pulley wheel 31 mounted on the coupling output shaft 15, a pulley wheel 32 mounted on the spindle of a potentiometer transducer 33 and a belt 34 engaging the two pulley wheels make possible the generation of a signal representative of the angular position of the arm 14. As shown by the dotted line 35, this signal is led from the transducer 33 to the spool speed adjusting means 9; the spool speed adjusting means 9 is arranged to be regulated in dependence on the signal in the sense to increase or reduce the spool speed if the signal reflects an increase above a predetermined value or a reduction below the predetermined value in the distance of the pulley block 21 from the pulley block 22. The signal is arranged to be a voltage proportional in magnitude to the angular displacement of the arm from its position when the pulley block 21 has the predetermined distance from the pulley block 22 and of one polarity or the other according to the sense of the angular displacement.

By virtue of the signal led in the line 35 to the spool speed adjusting means 9 the spool speed is automatically reduced in proportion to the increasing spooling diameter as wire builds up on the spool during spooling and so that the length of wire accommodated in the tension controller is not reduced; a reduction would constitute a diminution of the tension controller's full ability to act as a buffer. By virtue of the same signal the spool speed is also automatically varied during the reciprocatory movements of the distributor pulley 4 along the spool during spooling, whereby to annul or substantially reduce periodic movements of the arm that would otherwise ensue. The wire tension controller acts as a buffer to permit, while always applying tension in the wire, temporary or transient differences between the speed of the wire arriving at the tension controller and the speed of the wire leaving it, which differences, however, the described control scheme tends continually to annul. A controller 41 on the one hand receiving the signal from the transducer 33 and on the other hand effecting the regulating of the spool speed adjusting means 9 is interposed in the line 35 and is arranged to provide a so-called proportional and integral control action.

The value of the tension to be maintained in the wire by the tension controller when the arm 14 is in its normal angular position corresponding to the predetermined distance of the pulley 21 from the pulley block 22 is pre-settable for the spooling operation through a regulator 42 of the current passed through the exciting coil 24 of the coupling. The same current passed through the exciting coil 24 when the arm 14 has other angular positions results in other values of the wire tension which depend on the angle made by the arm with its normal position and on the geometry of the disposition of the fixed pulley block 22 in relation to the normal position of the arm, the differences of which values from the value pre-set for the normal position may be tolerable over the experienced range of arm movement. It is arranged, however, that the exciting coil current of the coupling 13 is automatically adjusted in accordance with the angular position of the arm 14 in such a way that the tension controller exerts highly accurately the same tension on the wire at all positions of the arm over an envisaged range for a given pre-setting by the operator. For this purpose the transducer 33 is arranged to produce a second signal representative of the arm position which as shown by the dotted line 43 is led to the regulator 42 through a non-linear function circuit 44 adapted to provide a factor varying with the arm angle by which to modify the set exciting coil current so that the tension will be constant over a range of arm angles.

Figure 3:
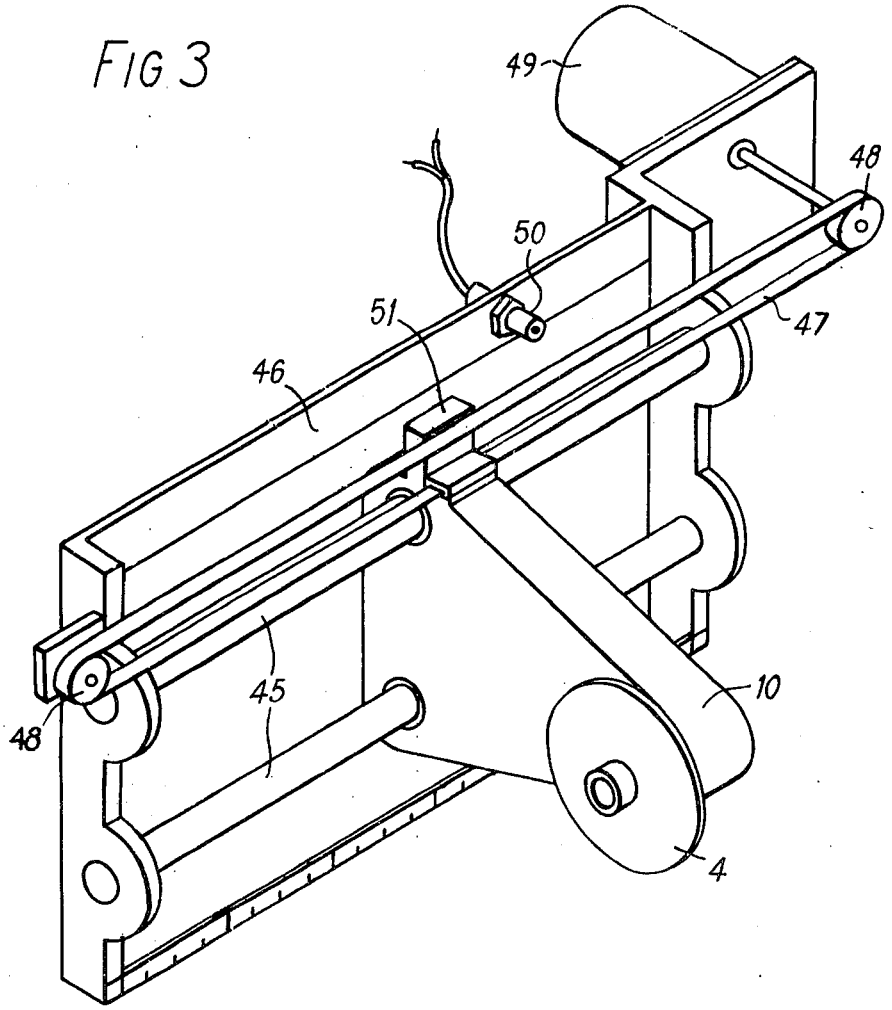
FIG. 3 shows diagrammatically means for reciprocating a distributor pulley carriage.

With reference more particularly to FIG. 3, the carriage 10 on which the distributor pulley 4 is freely-rotatably mounted is itself slidably mounted on a pair of guide shafts 45 fixed in a frame 46. An endless belt 47 of the timing belt kind passes over two suitable support pulleys 48 at respective sides of the frame and is secured to the carriage 10. One of the support pulleys 48 is driven directly by an electrical stepping motor 49. A proximity switch 50 to be actuated by the passage of a tongue 51 on the carriage 10 is mounted on the frame 56 at some intermediate position well away from the ends of the possible reciprocatory movement of the carriage 10 in the frame 46.

Figure 4:
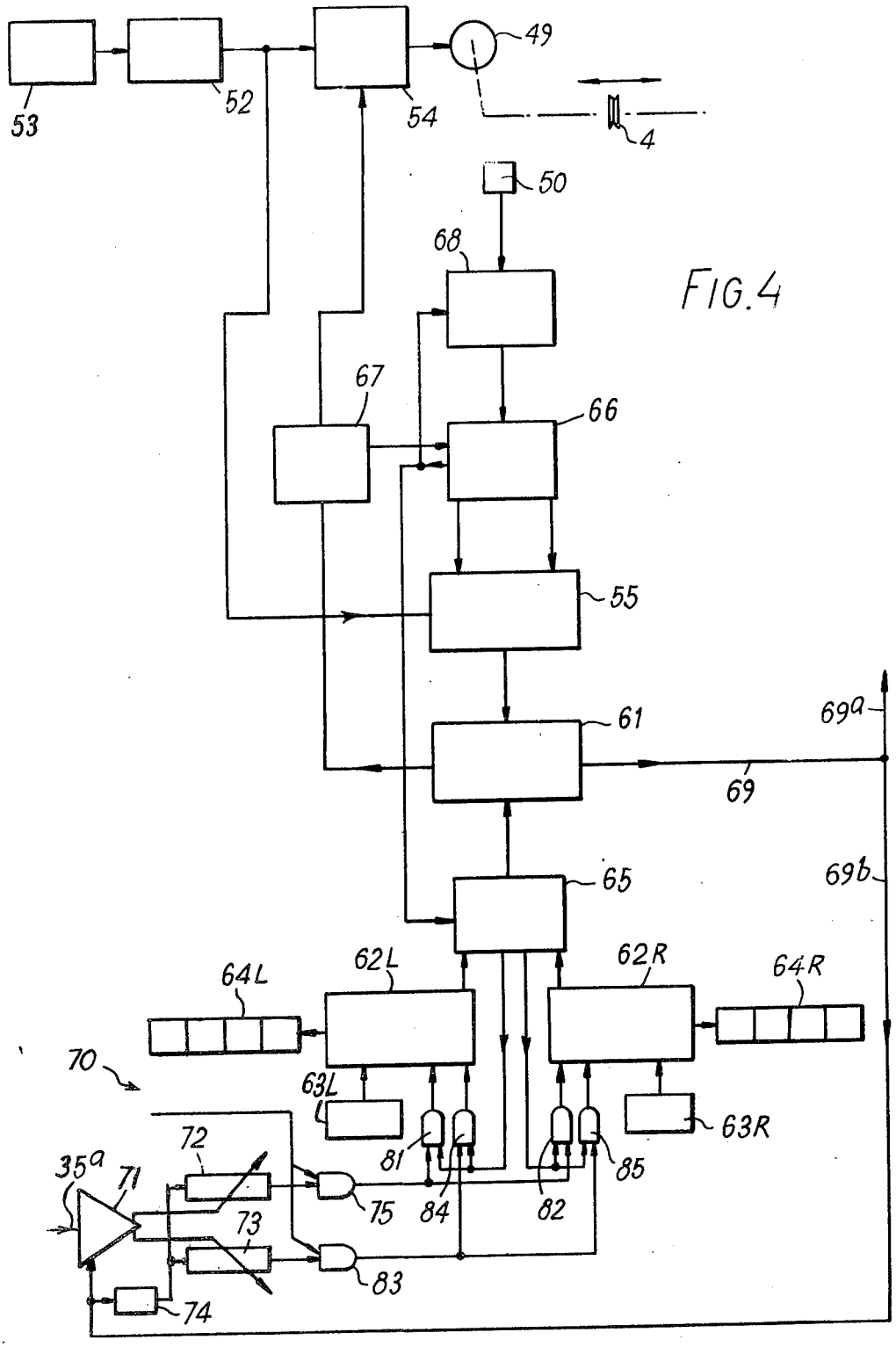
FIG. 4 is a block diagram of an arrangement for automatically reciprocating and automatically varying the reciprocatory travel in either direction of the distributor pulley carriage of FIG. 3, this Figure to be understood in conjunction with FIGS. 1 to 3.

With reference to FIG. 4, the stepping motor 49 supplied with current in a usual way (not shown), is actuated from a constant frequency pulse generator 52, of which the frequency is regulable by a speed control 53, which in a known manner effects drive of the motor 49 in one sense of rotation or the other, the direction of rotation is determined by a direction control 54. The pulses sent to the motor are also sent to a counter 55, which also receives signals from the proximity switch 50 as the tongue 51 passes it in one direction or the other, whereby the counter 55 is enabled to produce an output, when the carriage 10 is moving so as to increase the distance of the tongue 51 from the proximity switch 50, which at every moment is a measure of the said distance. The output of the counter 55 is applied to a comparator 61, which also receives an output from a left limit register 62L or an output from a right limit register 62R having respective adjustment facilities 63L and 63R for manual settings of the limits and respective panels 64L and 64R for the display of the set limits. The comparator 61 is arranged to compare the fixed output from the limit register 62L or 62R with the varying output from the counter 55 and to operate when the two outputs coincide in value to signal the direction control 54 to reverse the direction of the motor 49.

Which of the two limit register outputs is applied to the comparator 61 is determined by a left limit-right limit selector 65 which is under the control of control logic 66, which is arranged to receive an output from a reversing signal control 67 in the reversing signal line from the comparator 61 to the direction control 54. The control logic 66 is also arranged to reset to zero, when the reversing signal is issued by the counter 55, the pulse count in the counter 55 and to hold it at zero until an appropriate signal is delivered by the proximity switch 50, whereupon it enables the counter 55 to recommence counting. Furthermore, the control logic 66 receives a proximity switch signal through an edge selector 68 which is itself controlled by the control logic 66 and determines which of the two proximity switch signals as the tongue 51 passes the proximity switch 50, that is to say, the signals arising from the left and right hand edges of the tongue 51, is to be utilised as the starting moment for the counter.

The arrangement described ensures and controls automatic and continual reciprocation of the distributor pulley 4 between limits which can readily be arranged to be adjustable remotely from the spool 6 and frame 46, for example, at a control panel.

For the sake of abundant clarity, it is explained that as the carriage 10 moves towards the proximity switch 50 from left to right, say, the counter 55 is initially held at zero count. As the tongue 51 passes the proximity switch 50 the proximity switch 50 gives two signals in succession of which that due to the left-hand edge, say, of the tongue 51 is passed by the edge selector 68 to the control logic 66 which instantly permits the counter 55 to commence counting the pulses thereafter delivered by the pulse generator 52 to the motor 49 for the actuation thereof. The comparator 61 compares the increasing count in the counter 55 with the output from the right limit register 62R and when they coincide passes a signal through the reversing signal control 67 to the direction control 54 which reverses the motor direction. The corresponding signal from the reversing signal control 67 to the control logic 66 causes the latter to re-set the counter 55 to, and thereafter hold it at, zero count and at the same time to switch over the left limit-right limit selector 65 so that it is thereafter the output of the left limit register 62L which is applied to the comparator 61. The carriage 10 moves towards the proximity switch 50 from right to left and the foregoing sequence of coperations is repeated as explained but with the words "right" and "left" interchanged in the explanation, except that the edge selector 68 ensures that it is again the signal due to the passage past the proximity switch of the left-hand edge of the tongue 51 which initiates the counting.

Since the counts in the two direction start with the passages past the proximity switch of the same edge, as described, the left-hand edge, of the tongue 51 the sum of the counts is a measure of the total reciprocatory traverse without the necessity to take into account the width of the tongue.

As the wire builds up on the spool during spooling the spool speed requires to be reduced in proportion to the increased spooling diameter if the wire-drawing speed remains the same and as previously explained with reference to FIG. 1 the necessary change of spool speed is effected by the use of a signal derived from the angular position of the arm 14 of the tension controller 3 and applied to the spool speed adjusting means 9. The traversing speed of the distributor pulley 4 should be in proportion to the spool speed and thus the speed control 53 of the pulse generator 52 (FIG. 4) should be regulated in accordance with the spool speed as regulated by the adjusting means 9.

If either of the limit registers 62L and 62R is incorrectly set in relation to the position occupied by the relevant spool flange when the spool is mounted for a spooling operation, then the stepping motor is reversed either prematurely, with the winding of too little wire adjacent the flange, or belatedly, with the winding of too much wire adjacent the flange. It can be observed that in the former event the profile of the wound wire tends to assume a convex shape at its end nearer the flange, in any case the effective spooling diameter is reduced around the moment of motor reversal; in the latter event the profile of the wound wire tends to assume a concave shape at its end nearer the flange, in any case the effective spooling diameter is increased around the moment of motor reversal. These changes in effective spooling diameter are capable of being detected by the changes they are capable of making in the positioning of the arm 14 of the wire tension controller.

The comparator 61 is arranged to give, besides the mentioned signal for reversal of the stepping motor 49 causing the traversing of the distributor pulley 4, a further or enabling signal, caused to prevail in the output signal line 69 from the comparator 61 when and only when the difference between the counter output supplied to the comparator 61 from the counter 55 and the output supplied to the comparator 61 from the left limit register 62L or the right limit register 62R as the case may be has less than a predetermined value; the predetermined value may be varied in any suitable way. Since in the arrangement described with reference to FIG. 4 this further or enabling signal is delivered only when the distributor pulley 4 is approaching an end of its traverse, it will be termed the reversal approach signal. One branch **69*a* (FIGS. 1 and 4) of the output signal line 69 leads to the spool speed adjusting means 9, which is arranged when receiving the reversal approach signal not to respond to any demand for a change in spool speed arriving at the said adjusting means 9 via the signal line 35 from the potentiometer transducer 33. Another branch 69*b* of the output signal line 69 leads to a system 70 for automatically adjusting the settings of the left limit and right limit registers 62L and 62R**.

The system 70 comprises an amplifier 71, timers 72 and 73, a source (not shown), which will be termed a clock, of regular pulses, a monostable circuit 74 and various gates. The signal line branch **69*b* leads to the amplifier 71 for the control of the operation thereof and also to the monostable circuit 74**.

The amplifier 71 is arranged to receive as its input the output in a branch **35*a* (FIGS. 1 and 4) of the signal line 35 of the potentiometer transducer 33 but to accept its input only during the duration of the reversal approach signal, it is also arranged to hold after the reversal approach signal has been terminated an output proportional to the value of the said input at the moment of reversal approach signal termination and to apply it to the timer 72 if the said output has one polarity and to the timer 73 if the output has the reverse polarity. The timer receiving the output is arranged to have a length of run after being triggered which is proportional to the value of said output. The monostable circuit 74 is arranged to be triggered by the termination of the reversal approach signal and, upon returning to its stable state after a predetermined interval, to trigger the timer, only one of which will run under given circumstances because the other receives no signal from the amplifier 71**.

The timer 72, if running, holds open a gate 75 for the passage of clock pulses to a gate 81 to the register 62L and to a gate 82 to the register 62R, while if it is the timer 73 that is running it holds open a gate 83 for the passage of clock pulses to similar gates 84 and 85 respectively associated with the registers 62L and 62R. The left limit-right limit selector 65 is arranged to hold open either the pair of gates 81 and 84 or the pair of gates 82 and 85 according to how the said selector has been controlled by the control logic 66.

In operation, the reversal approach signal transmitted through the branch **69*a* to the spool speed adjusting means 9 ensures that the spool speed remains constant during the last part of the distributor pulley trasverse in either direction, wherefore the before-mentioned reduction or increase in effective spooling diameter if the reversal point is incorrectly set in the register 62L or 62R is reflected in a departure of the arm 14 of the tension controller 3 in the one direction or in the other direction from its normal position. The said departure tends to increase up to the moment of traverse reversal and the maximum departure tends to be greater the greater the setting error in the relevant limit register. The greater the arm departure from its normal position the greater the signal applied through the line 35*a* to the amplifier 71. Suppose the left limit register is set too low, the effective spooling diameter is reduced in the last part of the distributor pulley traverse towards the left and suppose the polarity of the resulting signal applied to the amplifier 71 corresponds to an actuation of the timer 72, then the timer 72, when triggered later than the moment of traverse reversal by a delay imposed by the monostable circuit 74, runs for a length of time proportional to the displacement of the arm 14 from its normal position at the moment of traverse reversal and a proportional number of clock pulses pass through the gate 81 to the left limit register 62L to effect a proportional correction in the left limit setting while the distributor pulley 4 is travelling from left to right. If the left limit register 62L had been set too high, then the signal at the amplifier 71 would have been of the opposite polarity, it would have been the timer 73 that was actuated, and the left limit register 62R would have received correcting clock pulses through the gate 84. If it is a matter of a correction of the right hand traverse reversal point, the actuations are the same except that the selector 65 ensures that it is the gates 82 and 85 to the register 62R which are open instead of the gates 81 and 84**.

If a stepping motor for reciprocating the distributor pulley carriage 10 is not available or if it is desired for any other reason to use another kind of motor for the purpose, the counter 55 could be arranged to receive pulses from a pulse-generating rotary transducer (not shown) driven for example by the support pulley 48 other than that driven by the said motor.

Figure 2:
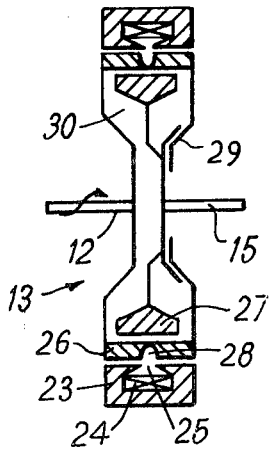
FIG. 2 shows diagrammatically the construction of a magnetic powder variable torque drive for the dancing arm.
Figure 5:
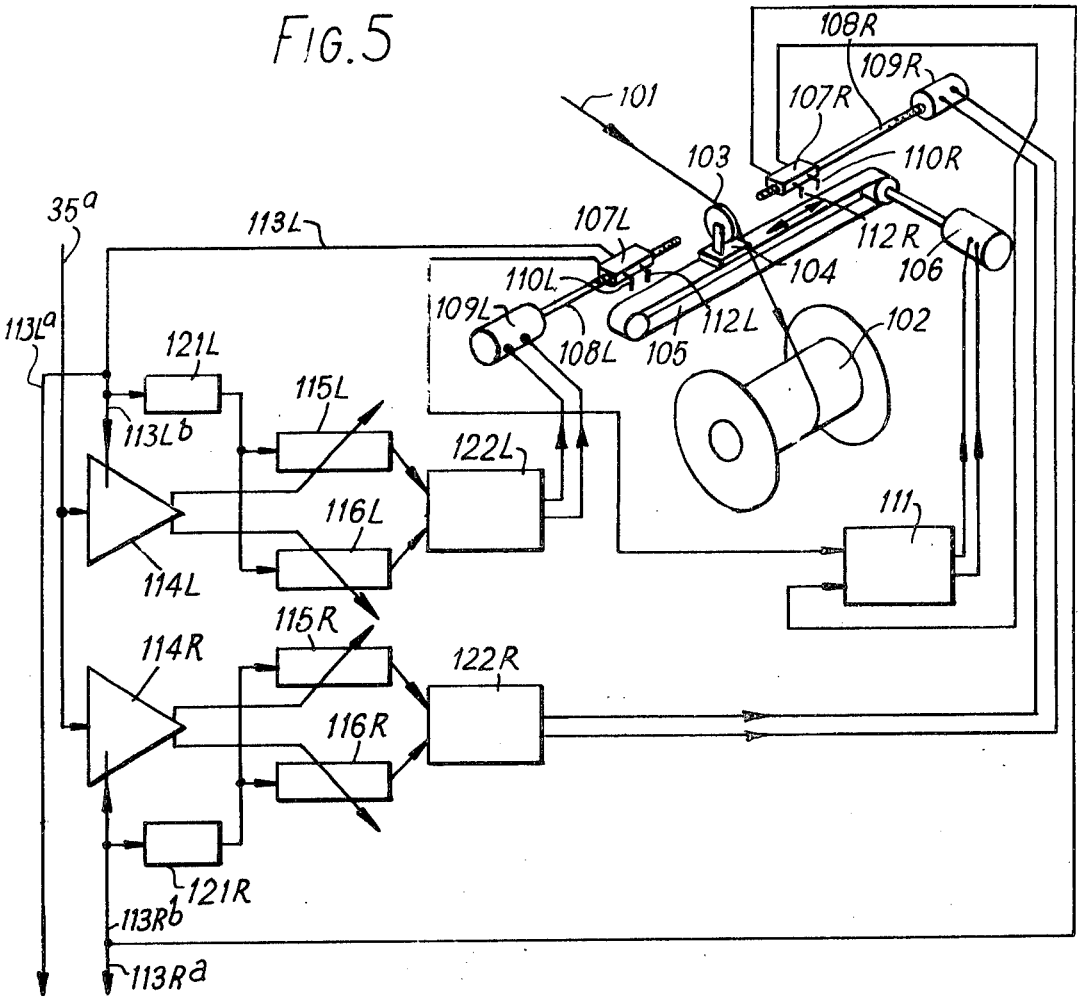
FIG. 5 is a block diagram of a modification of the arrangement described with reference to FIGS. 1 to 4.

With reference to FIG. 5, wire 101 to be wound on a spool 102 travels through a wire tension controller (not shown) of the kind shown in and described with reference to FIGS. 1 and 2 and passes onto the spool over a freely rotatable distributor pulley 103 mounted on a carriage 104 arranged for reciprocation parallel to the spool axis. The carriage 104 is secured to an endless belt 105 driven by a reversible motor 106 controlled as to its moments of reversal by means to be described.

Towards each end of the reciprocatory traverse of the carriage 104 there is arranged adjacent the path of the said carriage a switch block carrying switches which can be operated by the movement of the carriage. With reference in FIG. 5 to the left end region of the traverse, a switch block 107L is shown which is supported by means (not shown) in which it may slide parallel to the spool axis, the switch has a part engaged by a lead screw 108L which extends parallel to the spool axis and which is rotatable in either direction by a lead screw motor 109L. The switch block carries a limit switch 110L which is positioned so as to be operable by the carriage 104 when the latter reaches the switch when moving towards the left, the switch when so operated being arranged to send to a direction control 111 for the motor 106 a signal having the effect of reversing the motor direction; the switch 110L is spring-loaded or otherwise arranged so that it returns to its original condition as the carriage moves away from the switch towards the right.

The switch block 107L also carries a reversal region switch 112L which, during the movement of the carriage 104 towards the left, is arranged to be operated by the carriage when the carriage is at a fixed distance from the limit switch 110L, to remain in operated condition until the carriage again moves past it but moving towards the right and to resume then its original condition.

Figure 6:
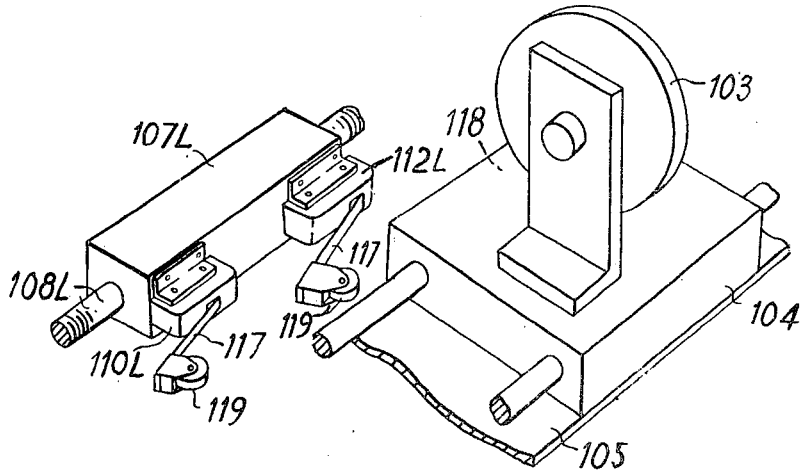
FIG. 6 illustrates a manner in which left limit and reversal region switches in the arrangement according to FIG. 5 may be operated by the distributor pulley carriage.

With reference to FIG. 6, the switches 110L and 112L mounted on the switch block 107L may have respective spring-biased pivoted arms 117 each of which may be held turned against its bias to operate its switch when a surface 118 of the distribution pulley carriage 104 engages a roller 119 at the end of the arm.

With reference to FIG. 5, the switch 112L when in operated condition but not otherwise is arranged to supply a left reversal region signal in a line 113L which has a branch **113L*a* which leads to means such as the means 9 in FIG. 1** by which the spool speed may be maintained constant during the time that the left reversal region signal prevails.

The line 113L has another branch 113L*b* which leads to a system for automatically correcting if necessary the left reversal position of the carriage 104. This system comprises an amplifier 114L, a pair of timers 115L and 116L, a monostable circuit 121L and a motor control 122L for the lead screw motor 109L. For this system the left reversal region signal is an enabling signal enabling the system to accept a signal representative of the wire tension controller arm position, as will be explained.

The amplifier 114L is arranged to receive as input a signal in a line 35*a* which is of one polarity or the other according as the wire tension controller arm is to one side or the other of its normal position and which has a magnitude proportional to the said arm's departure from its normal position. The amplifier can accept the signal in the line 35*a*, however, only if it is signalled in the branch 113L*b* that the switch 112L is in operative condition. The amplifier has two output lines one of which applies to the timer 115L, when the amplifier input signal is accepted, a signal proportional to the amplifier input signal magnitude if the amplifier input signal has one polarity and the other of which applies, when the amplifier input signal is accepted, a similar signal to the other timer 116L if the amplifier input signal has the other polarity. Either timer that receives a signal from the amplifier is arranged to send, when triggered, and for a period of time proportional to the amplifier output signal at the moment it is triggeed, a signal which is arranged to influence the motor control 122L to run the lead screw motor 109L for the said period of time. The direction in which the lead screw motor is run depends upon which one of the two timers sends signals to the motor control 122L.

The monostable circuit 121L is a circuit having a stable condition from which it may be disturbed by the receipt of a suitable signal but which re-assumes its stable condition after a predetermined lapse of time. The circuit 121L is connected to the branch 113L*b* and arranged to be disturbed from its stable condition by the putting out of operation of the reversal region switch 112L by the carriage 104 in receding from its left reversal point; the circuit 121L re-assumes its stable condition at a subsequent moment, by which time the carriage 104 has moved further to the right and clear of the swtich block 107, and, when re-assuming its stable condition, it triggers the timers 115L and 116L.

Towards the right end region of the traverse of the carriage 104 there is arranged adjacent the path of the carriage a switch block 107R carrying switches 110R and 112R and with a part engaged by a lead screw 108R rotatable by a lead screw motor 109R. The switches 110R and 112R are operable by the carriage 104 in the same manner as are the switches 110L and 112L, but the switch 110R is arranged when operated to ensure traverse reversal of the carriage at the right end of its path while the switch 112R is associated with a system for correcting the positioning of the switch block 107R, such system being similar to that described for the automatic re-positioning of the switch block 107L and having similar components designated by the same reference numerals but with the suffix R instead of L.

In operation, the carriage 104 is driven by the motor 106 along a traverse alternately from right to left and from left to right carrying as it does so the distributor pulley 103 for the winding of the wire 101 onto the spool 102. The reversal of the carriage movement from a leftward to a rightward direction ensues from the operation by the carriage of the left limit switch 110L and the reversal from a rightward to a leftward movement ensues from the operation of the right limit switch 110R.

At each end of its path the carriage, before it reaches the limit switch 110L or R, operates a reversal region switch 112L or R which remains in operated condition until the carriage leaves it when travelling in reversed direction. During the period in which the switch 112L or R is in operated condition, the spool speed is caused by means of the signal in the line 113L*a* or 113R*a* to remain constant so that a change in effective winding diameter during this period tends to cause a movement of the arm 14 of the wire tension controller 3. The movement of the said arm is signalled through the line 35*a* to the amplifiers 114L and 114R of the systems for automatically re-positioning the switch blocks 107L and 107R, one of which amplifiers is enabled to accept the signal in the line 35*a* by reason of receiving a signal in the line 113L*b* or 113R*b*. The termination of the said periods effects the holding of its output by the amplifier at the value corresponding to the final value of the input thereto at the said termination and effects also triggering of the corresponding monostable circuit 121L or R, which after its predetermined time lapse triggers the corresponding timers 115L and 116R or 115R and 116R whereby, in the manner previously indicated, the switch block 107L or R is re-positioned proportionally to the said final value of the input to the corresponding amplifier. By virtue of the monostable circuit time lapse, the switch block re-positioning is effected when the carriage 104 is clear of the switch block under consideration when moving away from it.

The switch block is arranged to be re-positioned to prolong the travel of the carriage in a given direction before reversal if the said final value of the arm position signal in the line 35*a* has a polarity signifying a reduced effective winding diameter in the neighborhood of the reversal point. A reduced effective winding diameter would be a result of reversing the carriage before the succession of coils being laid down has been brought right up to the spool flange. The more premature a carriage reversal in relation to a flange, the greater the receding of the wound wire profile at its end adjacent the flange that will tend to develop as a result of a series of premature reversals; however, the greater tends to be in consequence the said final value of the arm position signal in the line 35*a* and the greater the repositioning of the approach switch block 107L or R with the subsequent delivery of more wire adjacent the flange to tend to correct the said profile. Similarly, the switch block is re-positioned to curtail the carriage travel in a given direction before reversal if the arm position signal in the line 35*a* is of the opposite polarity, signifying an increased effective winding diameter adjacent the flange. An increased effective winding diameter would result from reversing the carriage after the succession of coils being laid down has been brought right up to the sppol flange. The more belated a carriage reversal in relation to a flange, the greater the build up of wire adjacent the flange; however, the greater tends to be in consequence the said final value of the arm position signal in the line 35*a* and the greater the repositioning of the appropriate switch block 107L or R with the subsequent delivery of less wire adjacent the flange.

The motor 106 is shown as controlled for its reversals. Its speed will be adjusted in relation to that of the spool, as described in connection with the motor 49 in the arrangement of FIGS. 1 to 4. The spool 102 will be driven at a speed diminishing as the wound wire builds up on the spool in the manner described in connection with the spool 5 in the arrangement of FIGS. 1 to 4.

We envisage that certain features in the traverse limit correcting scheme of FIG. 4 might replace if desired certain features in the scheme of FIG. 5 and vice-versa. For example, in replacement of the set-up in FIG. 5 with two amplifiers, four timers and two monostable circuits one might well use a set-up with one amplifier, two timers and one monostable circuit together with a steering logic system with gates arranged analogously to the gates 81, 84, 82 and 85 of FIG. 4 but leading to the motors 109L and 109R and controlled by the direction of control 111.

The arrangements illustrated are applicable to cylindrically-wound spools and also to taper-wound spools; it will be understood that with the latter the periods, adjacent the moments of traverse direction reversals, in which the spool speed is maintained constant and changes in wire length in the wire tension controller are detected and utilised to vary the distribution lengths in either direction should not be unduly large.

We claim:

1. A wire spooler, comprising a spool having end flanges, a motor arranged for rotating the spool, a lead-in pulley arranged for leading the wire onto the pulley between the end flanges, means for effecting between the spool and the lead-in pulley a relative reciprocatory movement that distributes the wire along the spool between the end flanges while it is being wound onto the spool, a wire tension controller having fixed pulley means and movable pulley means biased in a direction away from the fixed pulley means and arranged with the wire passing around both pulley means before it travels to the lead-in pulley, signal-generating means arranged for generating a measuring signal representative of the distance between the fixed pulley means and the movable pulley means, spool speed adjusting means arranged in dependence upon the measuring signal to regulate the spool speed in the sense to maintain said distance constant, and reversal point adjusting means for adjusting the reversal points of the relative reciprocating movement, the improvement comprising the combination of further signal-generating means arranged to detect periods starting when the lead-in pulley has approached to within a fixed distance from a reversing point and ending when the lead-in pulley reaches the reversing point and to generate during such periods a signal preventing during such periods regulation of the spool speed in dependence on the measuring signal and to make possible transfer at the end of each such period of the final value attained by the measuring signal during the period to operating means for the reversal point adjusting means, said operating means being caused to be responsive to said final value of the measuring signal to change the reversal point by a distance proportional to said final value of the measuring signal in the sense to reduce wound wire profile deficits or excesses adjacent the spool end flanges.

2. A spooler as set forth in claim 1, wherein control circuitry for reversing the drive for the said relative reciprocating movement is actuable by the comparison with pre-set values of signals indicative of the position of the lead-in pulley relatively to a fixed point along the relative reciprocating movement.

3. A spooler as set forth in claim 2, wherein the passage of the carriage past the fixed point in either direction is arranged to initiate the comparison with the appropriate pre-set value of the position of the lead-in pulley to the appropriate side of the fixed point.

4. A spooler as set forth in claim 3, wherein comparison of signals indicative of the position of the lead-in pulley relative to the fixed point with different pre-set values is arranged to generate the said signal preventing during the said periods regulation of the spool speed in dependence on the measuring signal.

5. A spooler as set forth in claim 4, wherein the lead-in pulley is arranged to be driven by a stepping motor, counting means are arranged to count from the moment the lead-in pulley passes the fixed point in either direction the pulses delivered to the stepping motor for the operation thereof, comparator means are arranged to compare the pulse counts with numbers in limit registers and a second source of pulses is provided for changing the numbers in the limit registers.

6. A spooler as set forth in claim 5, wherein associated with each limit register a pair of timers is provided for controlling the time of passage of second source pulses to the limit register for the changing of the number therein, said timers being under the control of the said measuring signal at the moment of reciprocation reversal.

7. A spooler as set forth in claim 6, wherein neither timer is permitted to operate until after a delay from the moment of reciprocation reversal.

8. A spooler as set forth in claim 1, wherein said wire tension controller is provided with a dancing arm having means for providing dancing arm torque which comprises a drive coupling, arranged to be used in a non-rotary out-put mode, of a kind adapted through the action under the influence of a magnetic field of adjustable strength in a gap between rotary driving and driven members of ferro-magnetic powder in said gap to transmit rotary power between its input and output shafts.

9. A spooler as set forth in claim 8, wherein means are provided for adjusting in dependence upon the measuring signal the regulating means for the excitation current for the magnetic field of the drive coupling in such a way as to ensure that the wire tension is independent of the distance between the fixed pulley means and the movable pulley means within an operating range of movable pulley means positions.

* * * * *